US006951118B2

(12) United States Patent
Brennan

(10) Patent No.: US 6,951,118 B2
(45) Date of Patent: Oct. 4, 2005

(54) COMPARTMENT FOR AUGMENTING AVAILABLE SPACE REFRIGERATED BY A CHEST REFRIGERATOR

(75) Inventor: Richard Brennan, Wangara (AU)

(73) Assignee: Recreational R & D Pty Ltd., Wangara (AU)

( * ) Notice: Subject to any disclaimer, the term of this patent is extended or adjusted under 35 U.S.C. 154(b) by 0 days.

(21) Appl. No.: 10/669,172

(22) Filed: Sep. 22, 2003

(65) Prior Publication Data

US 2004/0112080 A1 Jun. 17, 2004

Related U.S. Application Data

(63) Continuation-in-part of application No. PCT/AU03/00341, filed on Mar. 21, 2003.

(30) Foreign Application Priority Data

Mar. 22, 2002 (AU) ..... PS1282

(51) Int. Cl.[7] ..... F25B 27/00; F25B 21/00; B60H 1/32; F25D 3/08; F17C 13/00

(52) U.S. Cl. ..... 62/457.9; 62/457.7; 62/326; 62/328

(58) Field of Search ..... 62/457.9, 457.7, 62/371, 326, 328, 457.1; 220/23.83, 592.03, 592.09, 501, 23.86

(56) References Cited

U.S. PATENT DOCUMENTS 5,040,681 A * 8/1991 Grusin ..... 206/503
6,371,320 B2 * 4/2002 Sagol ..... 220/4.27
6,698,210 B2 * 3/2004 Ogura et al. ..... 62/6

FOREIGN PATENT DOCUMENTS

| | | | | |
|---|---|---|---|---|
| AU | A-70275/96 | * | 5/1997 | ..... F25D/11/00 |
| AU | 70275/96 A | | 8/1997 | |
| JP | 2001311576 A | * | 11/2001 | ..... F25D/11/00 |
| RU | 2081377 C1 | | 8/1997 | |

OTHER PUBLICATIONS

DP Refrigeration Australia Portable Fridges/Freezers: Bushman 42 litre with hi lid; Retrieved from the Internet on Apr. 2, 2003 at http://www.dprefrigeration.com.au/portable.htm.

* cited by examiner

*Primary Examiner*—Chen Wen Jiang
(74) *Attorney, Agent, or Firm*—Townsend and Townsend and Crew LLP

(57) ABSTRACT

A compartment for augmenting available space refrigerated by a chest refrigerator comprises a body configured to be coupled to a chest portion of the chest refrigerator. The body is configured to provide a hermetical seal between the body and the chest portion in use. The body has a cavity therein for receiving items to be refrigerated. The body is arranged such that when coupled to the chest portion the cavity is refrigerated by the chest portion. The body also has an opening for providing access to items in the cavity. The body is arranged to be coupled to a door for covering the opening in a hermetically sealed manner. An augmented chest refrigerator uses the compartment.

47 Claims, 7 Drawing Sheets

COMPARTMENT FOR AUGMENTING AVAILABLE SPACE REFRIGERATED BY A CHEST REFRIGERATOR

CROSS-REFERENCE TO RELATED APPLICATIONS

This Application is a continuation-in-part of International Application PCT/AU03/00341 filed Mar. 21, 2003.

FIELD OF THE INVENTION

The present invention relates to a compartment used to augment the available space in a chest refrigerator as well as a chest refrigerator fitted with the augmenting compartment.

BACKGROUND

Portable chest refrigerators provide a convenient means of storing and chilling food and beverage items, and they can also be readily installed in a variety of mobile vehicles such as campers, vans, trailers, mobile or motor homes, and marine vessels. Typically, the portable chest refrigerator includes a chest portion for storing and chilling food and beverage items and a lid portion that is mounted on an uppermost edge of the chest portion. The lid portion is provided with a refrigerator seal to afford a hermetic seal between the lid portion and the chest portion when the lid portion is closed. Generally the lid portion is hingedly connected along one side to the chest portion and/or secured to the chest portion by means of securing clips. A refrigerating means, including a motor and condenser, are generally disposed externally of the chest portion. The storage capacity of the portable chest refrigerator typically ranges from about 20 L up 60 L although portable chest refrigerators with larger storage capacities are known.

The present invention provides additional space for refrigerating items within a chest refrigerator.

SUMMARY OF THE INVENTION

According to a first aspect of the present invention there is provided a compartment for augmenting available space refrigerated by a chest refrigerator, said compartment comprising:

a body configured to be coupled, in use, to a chest portion of the chest refrigerator in a hermetically sealed manner, the body having a cavity therein for receiving items to be refrigerated in use, the body being arranged such that when coupled to the chest portion the cavity is refrigerated by the chest portion, the body also having a opening for providing access to items in the cavity in use, wherein the body is arranged to be coupled to a door for covering the opening in a hermetically sealed manner.

Preferably the body is arranged to be hingedly coupled to the door. Preferably the opening is in the top of the body. Alternatively the opening is in a side wall of the body.

According to a second aspect of the present invention there is provided a compartment for augmenting available space refrigerated by a chest refrigerator, said compartment comprising:

a body configured to be coupled, in use, to a chest portion of a chest refrigerator in a hermetically sealed manner, the body having a cavity therein for receiving items to be refrigerated in use, the cavity arranged to be refrigerated by the chest portion in use; and a door for providing access to the cavity, when opened, and arranged to be hermetically sealed when closed.

Preferably the door is from the chest refrigerator.

Preferably the door is hingedly coupled to the body. Preferably the door is removably hinged to the body.

In the first and second aspects of the invention, preferably the body is adapted to be hingedly coupled to the chest portion in use, such that the body may be pivoted to allow assess to an inside of the chest portion.

Preferably the body includes a bottom opening to allow thermal communication between the cavity and the inside of the chest portion in use. Preferably a barrier is provided across the bottom opening to prevent items in the cavity falling through the bottom opening.

Preferably the body is configured to be positioned between the door and the chest portion in use.

Preferably the body is thermally insulated, such that atmospheric heat is shielded from the cavity.

Preferably the body includes an air circulator for circulating air in the cavity and in the chest portion in use.

According to a third aspect of the present invention there is provided an augmented chest refrigerator comprising:

a chest portion having a first cavity therein for receiving items to be refrigerated;

a refrigeration unit for refrigerating the chest portion;

an augmentative body coupled to the chest portion in a hermetically sealed manner, the body having a second cavity therein for receiving items to be refrigerated in use, the second cavity being refrigerated by refrigeration of the chest portion; and a door for providing access to the cavity, when opened, and arranged to hermetically seal the chest portion and body when closed.

Preferably the body is hingedly coupled to the chest portion, such that the body may be pivoted to allow assess to the first cavity.

Preferably an opening in the bottom of the body allows thermal communication between the first and second cavities. Preferably a barrier is provided across the opening to prevent items in the second cavity falling into the first cavity.

In relation to the second and third aspects of the present invention, preferably the barrier is in the form of a grill. Preferably the grill is removable.

Preferably an interface between the body and the chest portion is hermetically sealed by a sealing means depending downwardly from a lower periphery of the bottom of the body.

Preferably an interface between the body and the door is hermetically sealed by a sealing means depending towards the body from a periphery of an inner face of the door.

Preferably the body is thermally insulated, such that heat is shielded from the second cavity therein.

Preferably the door is in the top of the body. Alternately the door in is a side wall of the body. Preferably the door forms part of a drawer in a side wall of the body.

Preferably the body includes an air circulator for circulating air in the second cavity and first cavity. Alternatively the chest portion includes an air circulator for circulating air in the second cavity and first cavity.

According to a fourth aspect of the present invention there is provided a compartment for use with a chest refrigerator comprising:

an open bottomed body with a cavity therein; and a sealing means around a lower periphery of the body; wherein the body is arranged such that in use it is coupled to an opening of a chest portion of the chest refrigerator such that the sealing means affords a hermetic seal between the body member and the chest portion, and the cavity is cooled by the chest portion.

Preferably the body is positioned between the chest portion and lid portion of the portable chest refrigerator in use, the lid portion sealably covering the open top of the body in use.

Preferably the arrangement between the body and the chest portion creates a first temperature zone in the chest portion and a second temperature zone in the cavity, the temperature of the first temperature zone being less than the temperature of the second temperature zone.

According to a fifth aspect of the present invention there is provided augmentative refrigerator compartment for use with a portable chest refrigerator, the augmentative refrigerator compartment comprising an open-topped and open-bottomed box member and a sealing means depending continuously around a lower periphery of the box member, wherein the box member is arranged in use to be mounted upon a chest portion of the portable chest refrigerator and between the chest portion and lid portion of the portable chest refrigerator such that the sealing means affords a hermetic seal between the box member and the chest portion, the arrangement being such that a first temperature zone is formed in the chest portion and a second temperature zone is formed in a space defined by the box member, the temperature of the first temperature zone being less than the temperature of the second temperature zone.

DETAILED DESCRIPTION OF THE DRAWINGS

In order to provide a better understanding, preferred embodiments of the present invention will now be described by way of example only, with reference to the accompanying drawings, in which.

DESCRIPTION OF PREFERRED EMBODIMENTS

Figure 1:
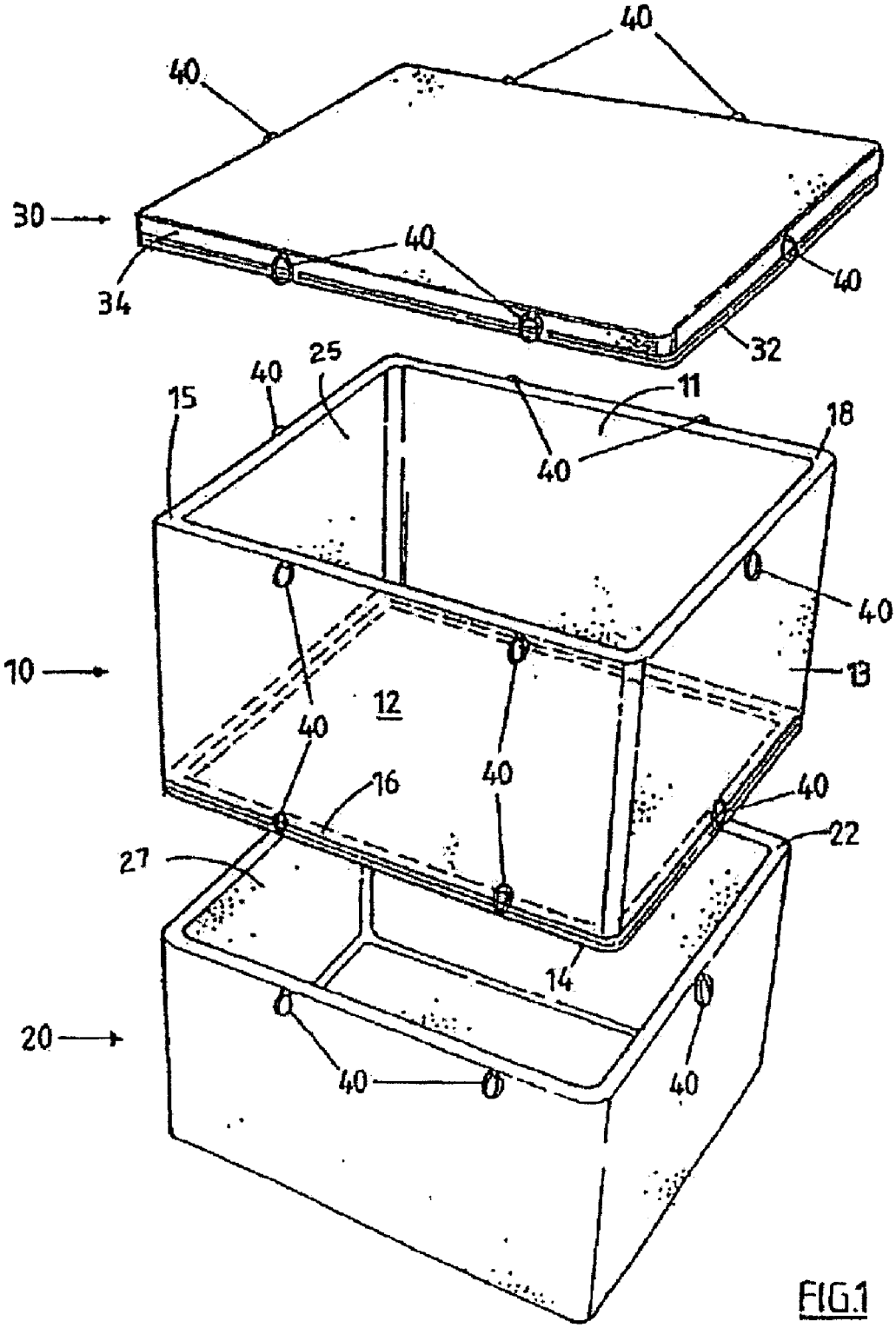
FIG. 1 is an exploded perspective view of preferred embodiment of a compartment in accordance in accordance with the present invention.
Figure 2:
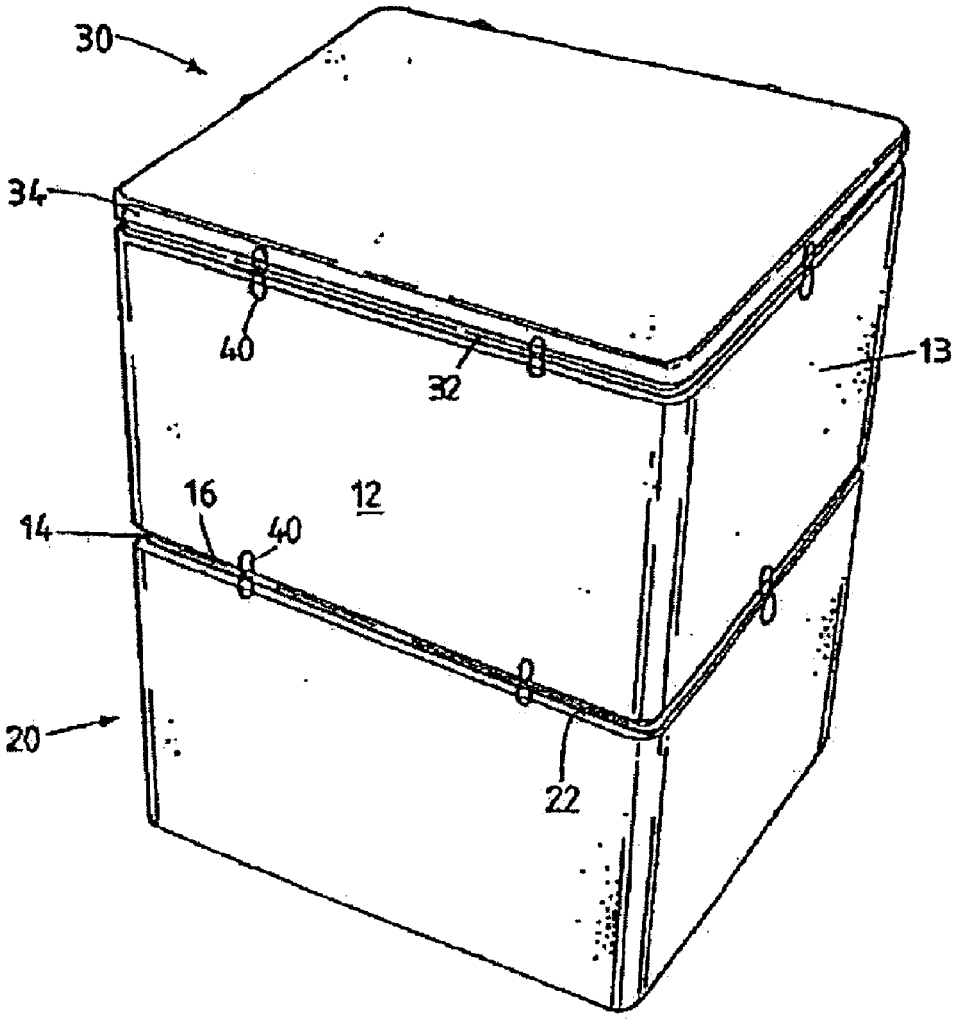
FIG. 2 is a perspective view of the compartment of FIG. 1 mounted between a chest portion and a leg portion of a conventional portable chest refrigerator.

Referring to FIGS. 1 to 7, there is shown a conventional portable chest refrigerator comprising a chest portion 20 and a lid portion (lid) 30, and augmenting compartment 10. A refrigerating means (not shown in these Figures) is disposed externally of the chest portion 20. The refrigerating means refrigerates the chest portion 20 in a conventional manner. It will be understood that the term portable chest refrigerator refers to portable chest freezers and portable chest refrigerators/freezers.

The lid or door 30 is provided with a seal 32 that depends continuously around a lower periphery 34 of the lid 30 to afford a hermetic seal between the lid 30 and chest portion 20 when the lid 30 is closed, that is, mounted flushly on an upper periphery 22 of the chest portion. The lid 30 may be hingedly connected along one side of the chest portion 20 and/or secured to the chest portion 20 by means of securing clips 40. Any suitable pivotal connection, such as a hinge may be used.

The compartment 10 includes a body 12 in the form of a box. In this embodiment the box is open-topped and open-bottomed. A second seal 14 depends continuously around lower periphery 34 of the body 12 in FIG. 4.

It will be understood that the seal 14 is formed from materials conventionally used to form seal 32 or materials from which other conventional refrigerators/freezer seals are formed.

The body 12 has an inner casing 11 concentrically spaced apart from an outer casing 13 and insulation 15 between the inner and outer casings 11 and 13. The interior of the casing 11 forms a void or cavity 25 within which items may be placed so that in use they may be refrigerated.

The inner and outer casings 11 and 13 are typically formed of anodized marine grade aluminium, non-anodized aluminium, stainless steel, plastic coated steel, or plastics material including moulded plastics or other such materials which would be used for a similar purpose in forming a chest portion 20 of a conventional portable chest refrigerator.

The insulation 15 is typically formed of conventional insulating materials such as would be used for a similar purpose in forming a chest portion 20 of a conventional portable chest refrigerator, for example polystyrene or polyurethane foam.

Figure 3:
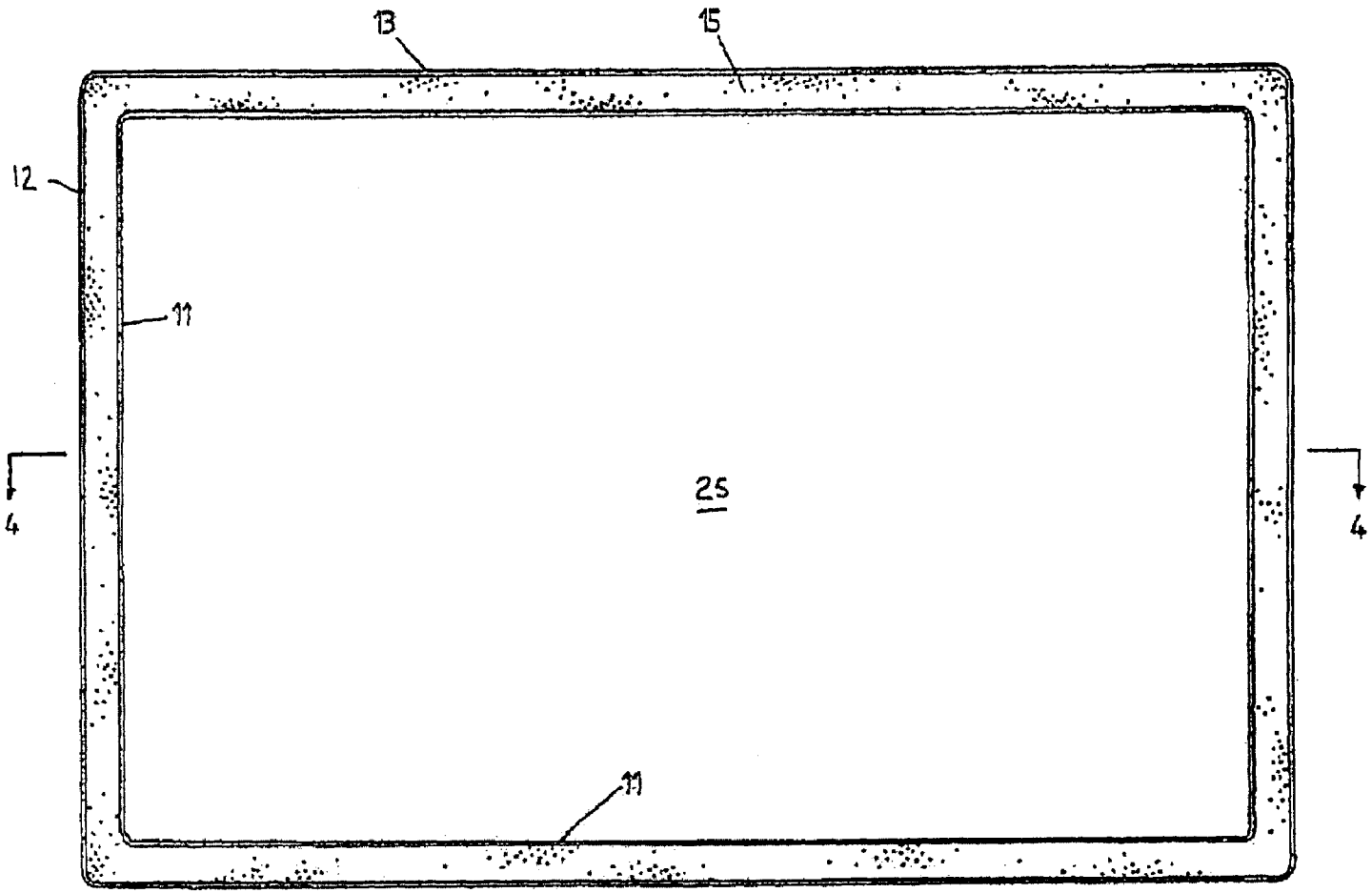
FIG. 3 is a planned view of the compartment of FIGS. 1 and 2.
Figure 4:
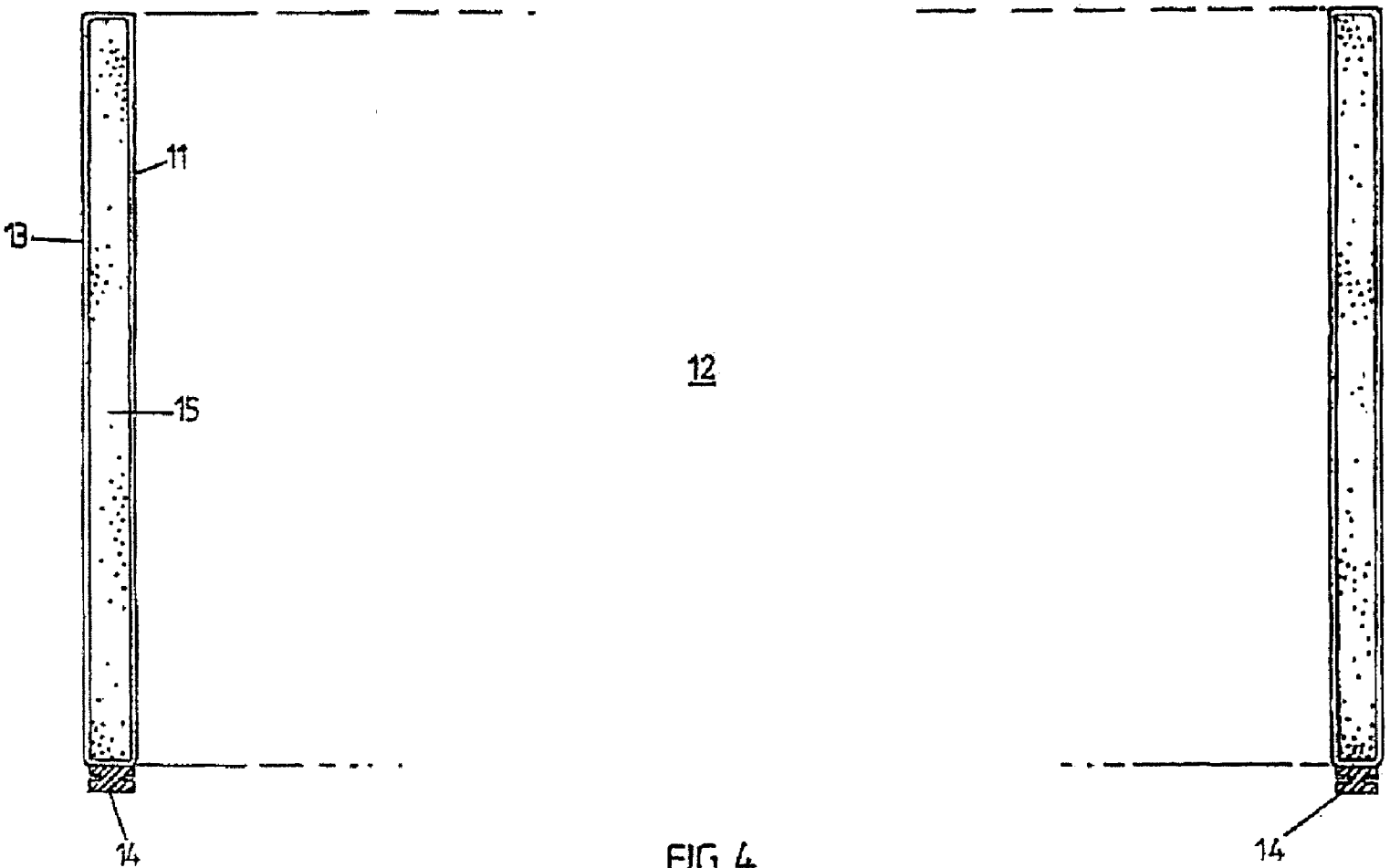
FIG. 4 is a vertical cross-section of the compartment along the line 44 or FIG. 3.

Preferably as seen in FIG. 3 the inner casing 11 is formed of one continuous piece to minimise the number of seams within the body 12, and consequently reduce the number of locations within the box member 12 where bacteria and other harmful micro-organisms could be harboured. Further as shown in FIG. 3, it is also preferred that the inner casing 11 be provided with curved corners rather than sharp corners for ease of maintenance and cleaning.

Figure 5:
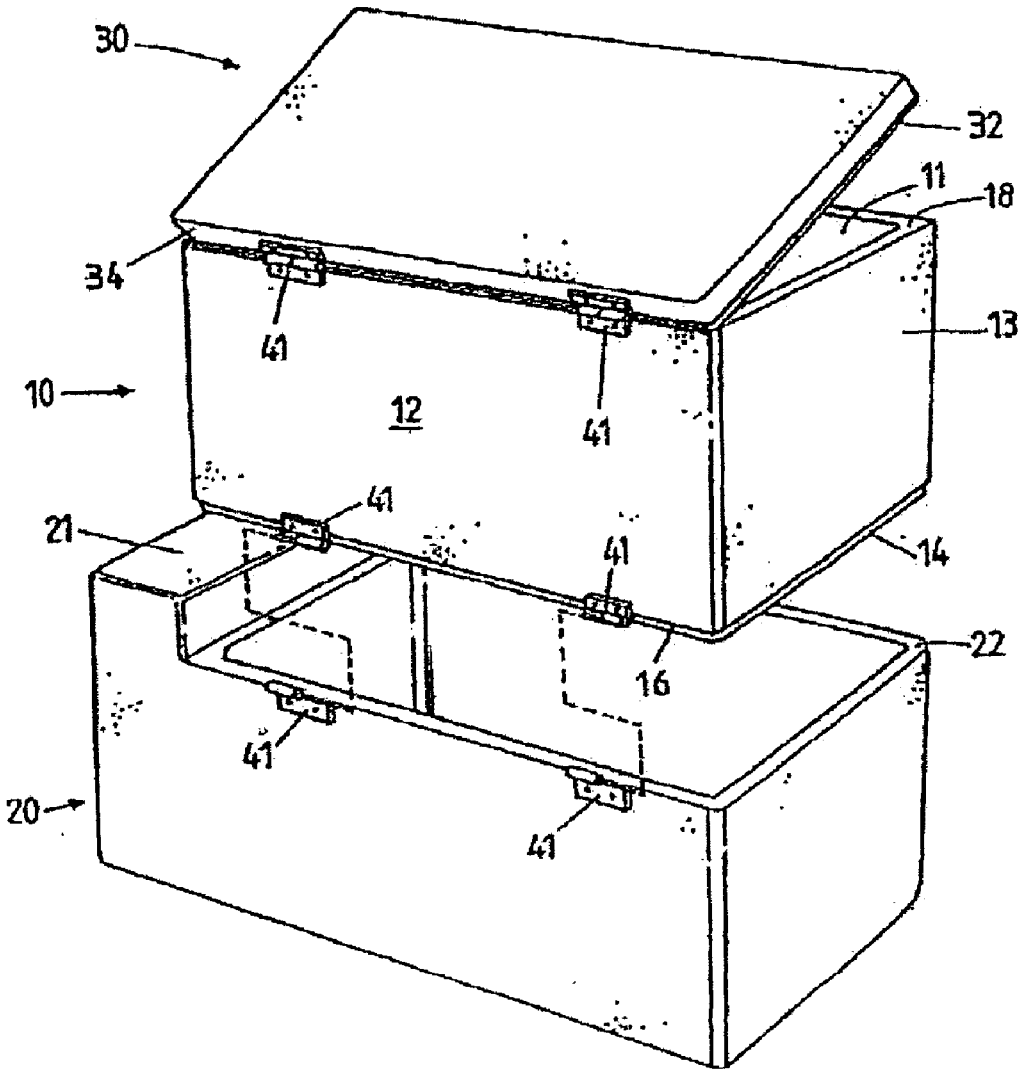
FIG. 5 is a perspective view of a second embodiment of the present invention.
Figure 6:
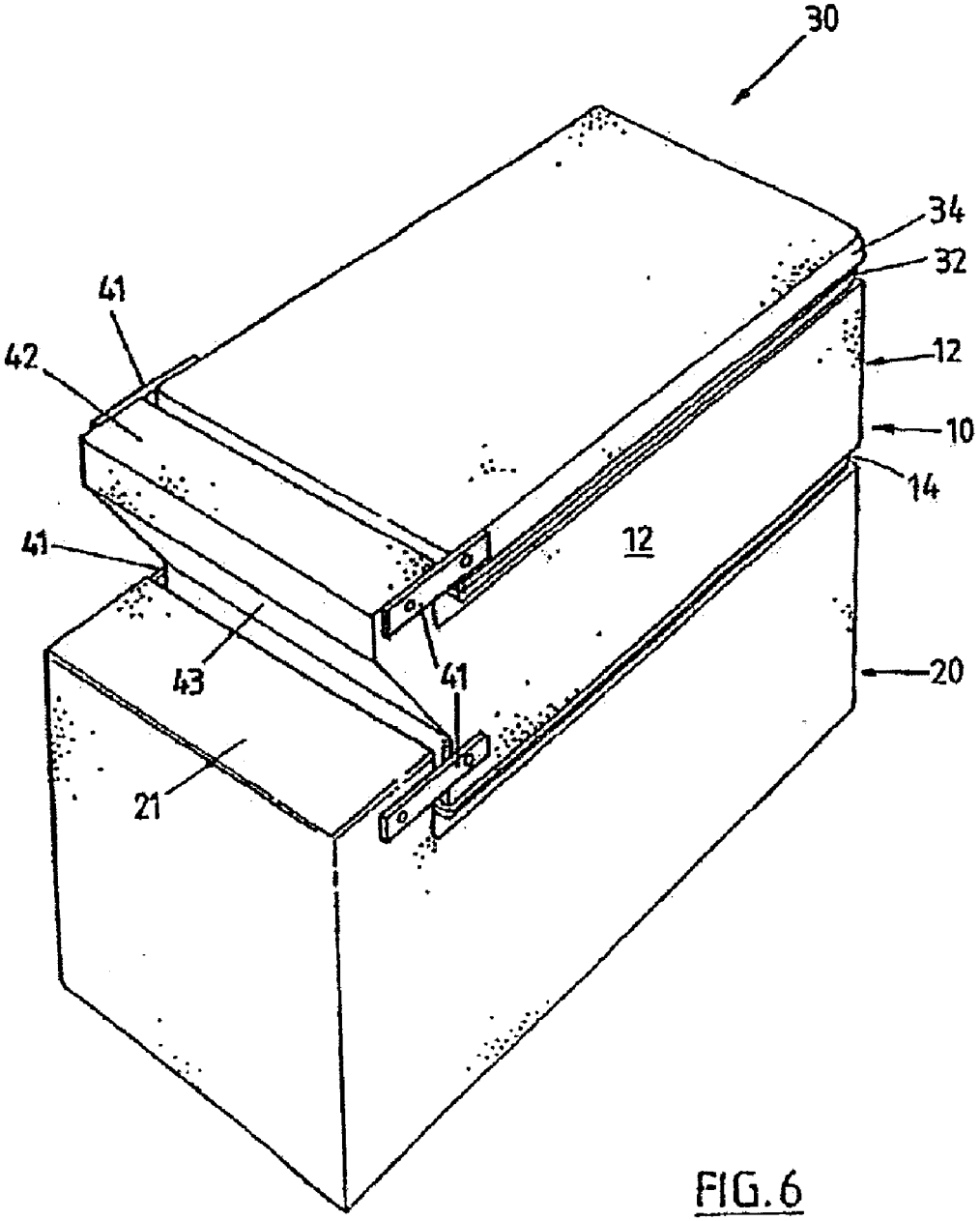
FIG. 6 is a perspective view of a third embodiment of the present invention.

The inner casing 11 is spaced apart from the outer casing 13 at a distance substantially corresponding to a wall thickness of the chest portion 20 of the conventional portable chest refrigerator. Furthermore, a horizontal cross-sectional shape of the body 12 substantially corresponds with the horizontal cross-sectional shape of the chest portion 20. In those circumstances where the chest portion has a motor-housing 21, such that the motor-housing defines a raised portion 21 of the chest portion 20 as shown in FIGS. 5 and 6, the aforementioned horizontal cross-section of the chest portion does not include the raised portion 21. Typically the horizontal cross-sectional shape of the chest portion 20 is substantially rectangular although it is envisaged that alternative shapes may be used. Furthermore the typical vertical cross-sections (longitudinally and transverse the length) are also substantially rectangular. Again other shapes may be used.

In use the body 12 is arranged to be vertically mounted upon and coupled to the chest portion 20 of the portable refrigerator. It is therefore important that the shape and size of the lower periphery 16 of the body member correspond to the shape and size of the upper periphery 22 of the chest portion 20 in order for the second seal 14 to abutt the upper periphery 22 of the chest portion so as to afford hermetic seal between the body 12 and the chest portion 20. When the body 12 is coupled to the chest portion 20 the cavity 25 is refrigerated by the chest portion 20. In this embodiment this occurs because the body is open-bottomed and allows refrigerated air within the cavity 27 of the chest portion 20 to cool the air within the cavity 25 of the body 12 by convection, conduction, radiation or any combination thereof.

An upper periphery 22 of the chest portion 20 is arranged to received the lower periphery 16 of the body 13 in the same way that the upper periphery 22 of the chest portion would receive the lid 30. In other words, the periphery 16 of the body 12 may be hingedly connected along one side of the upper periphery 22 of the chest portion to enable access to the cavity 27 inside the chest portion 20 without substantially disturbing the cavity 25 inside the body 12 or the contents thereof.

Preferably the upper periphery 22 of the chest portion 20 and the lower periphery 16 of the body 12 are provided with releaseable securing clips 40 to further secure the compartment 10 to the chest portion 20 and to assist the formation of the hermetic seal between the body 12 and the chest portion 20. When compartment 10 is not required, it may be readily removed from the chest portion 20 by releasing the releasable clips 40 from the body 12 and chest portion 20.

An upper periphery 18 of the body 12 is arrange to receive the lid 30 of the portable chest refrigerator in a manner similar to the upper periphery 22 of the chest portion 20 in convention use. In other words the lid 30 may be hingedly connected along one side of the upper periphery 18 of the body 12. Preferably the upper periphery 18 of the body 12 and lower periphery 34 of the lid 30 are also provided with releaseable securing clips 40 to further secure the lid 30 to the body 12 and to assist the formation of a hermetic seal between the body 12 and the lid 30. The lid 30 may be readily removed from the body by releasing the securing clips 40 on the body 12 and the lid 30.

In use the body 12 is arranged to be disposed between the chest portion 20 and the lid 30 of the portable chest refrigerator as described above, thus enclosing the cavity 27 in the chest portion 20 and enclosing the cavity 25 within the body 12.

In this way a first temperature zone may be formed in the cavity 27 and a second temperature zone may be formed in the cavity 25. The different temperature zones are formed generally because direct cooling is provided to the cavity 27 inside the chest portion 20 by the refrigeration means, whereas the refrigeration means does not directly cool the cavity 25 inside the body 12 of the compartment 10. Thus despite the insulation 15 (and depending on the ambient air temperature) some heat may enter the void of the body 12 which typically results in the second temperature zone being warmer than the first temperature zone.

However if the insulation 15 is sufficiently efficient then heat absorption within the body 12 due to the ambient temperature may be minimal. Furthermore given sufficient time the temperature within the cavity 25 of the body 12 and the cavity 27 of the chest portion 20 may substantially reach equilibrium. Furthermore an air circulation means as described further below may be used to circulated air within the cavities 25 & 27 to ensure that the temperature within the two temperature zones is the same.

In many instances it can be desirable to have the temperature in the first temperature zone less than the temperature in the second zone so that, for example, beverages items and other items that require lower temperatures for optimal storage can be stored and chilled in the cavity 27 of the chest portion, whereas other food items, such as fruit and vegetables, that require relatively high temperatures for optimal storage can then be stored and chilled in the cavity 25 of the body 12. It is envisaged that a basket which is sized and shaped to fit within the inner casing 11, could be provided to retain food and beverage items stored and conveniently chilled in the cavity 25 defined within the body 12. Thus if an air circulation means is provided it is desirable to have it controlled by a switch to allow a user to select whether the two zones are the same temperature or not.

As shown in the embodiment of FIG. 5, the lid 30 that may be hingedly connected to the upper periphery 18 of the body 12 along one longitudinal side by hinges 41. Further the lower periphery 16 of the body 12 may be hingedly connected along one side of the upper periphery 22 of the chest portion by hinges 41. In this embodiment convenient access is afforded to items stored in cavity 27 of the chest portion 20 by pivoting the body 12 about the hinges 41 to gain access to the cavity 27. Alternatively items stored in the cavity in the body 12 can be accessed by pivotally raising the lid 30. In this way access to items stored in the chest portion 20 can be obtained without removal of items stored in the body 12.

As shown in the embodiment of FIG. 6 hinge connections between lid 30 and the body 12, and between the body 12 and the chest portion 20 may be arranged at the same end of the compartment 10 proximal to the motor housing portion 21. In this embodiment body 12 has an end portion 42 which has a flat upper surface adjacent to the compartment defined by the body 12. A pair of hinges 41 extend between the end portion 42 and the lid 30.

A further pair of hinges 41 interconnects the chest portion 20 adjacent the motor housing 21 with the body 12. Further the body 12 has a second wall portion 43 which facilitates the pivotal movement of the body 12 and minimises obstruction to the motor housing 21. In this arrangement the body 12 may be conveniently pivotally raised to access items inside the chest portion 20, without the raised motor housing 21 hindering the motion of the hinged connection. Also the lid 30 may be independently pivotally raised to access items in the body if desired. This is conveniently shown in FIG. 7.

Figure 8:
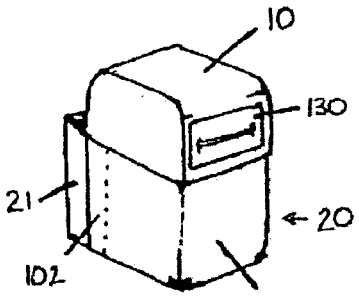
FIG. 8 is a upper perspective view of a fifth embodiment of the present invention.
Figure 9:
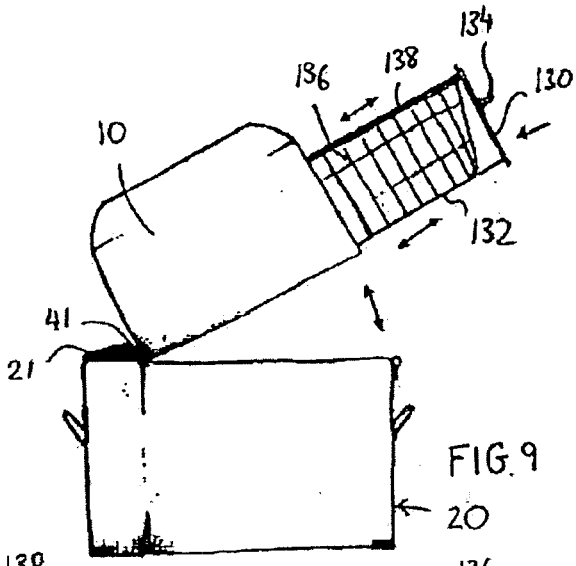
FIG. 9 is a side elevation of the embodiment shown in FIG. 8.
Figure 7:
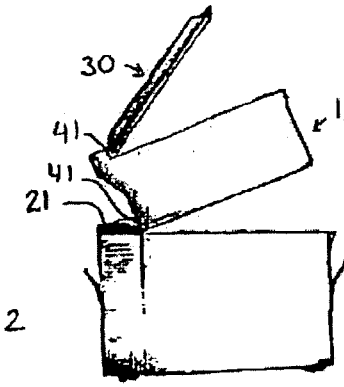
FIG. 7 is a side elevation of a fourth embodiment of the present invention.

An alternative embodiment of the present invention is shown in FIGS. 8 and 9. In this embodiment the body 12 includes a door 130 to a drawer 132. The door 130 has a handle 134 for pulling the drawer 132 out of the body 12. In this embodiment the door 130 may replace the lid 30 of the embodiments described above but would still provide a hermetic seal when closed in a similar manner to that described above. As can be seen in FIG. 9 the drawer 132 is formed of parallel rails 132 and 138 which are slidably withdrawn from within the cavity 25 of the body 12 when the drawer 132 is opened. Upper rails 138 support a basket 136.

Figure 10:
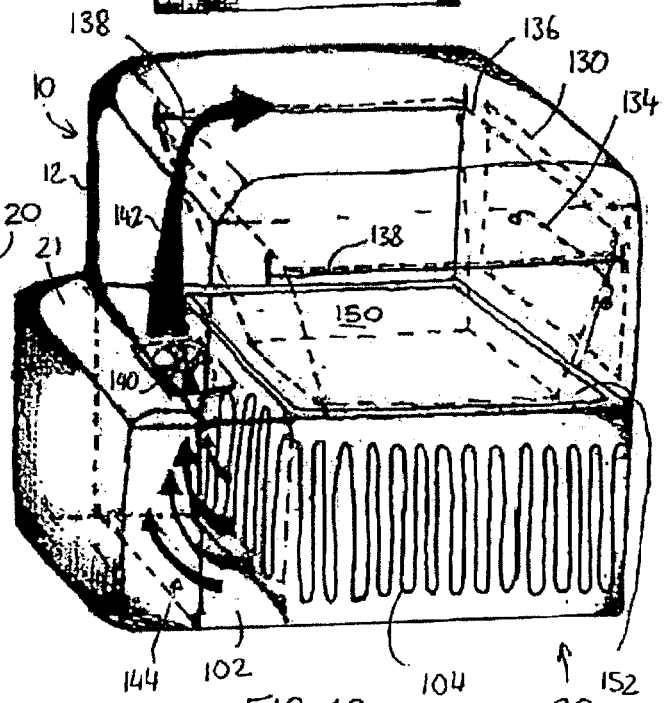
FIG. 10 is a further alternative embodiment of the present invention.

In the embodiment shown in FIG. 10 an air circulation means in the form of fan 140 is used to circulate air. It will be appreciated that the air circulation means need not take the form described herewith. The fan 140 can be provided either within the chest refrigerator as depicted in FIG. 10 or the fan may be provided within the body 12. It will also be appreciated that the air circulation means may be provided in the previous embodiments.

The chest refrigerator has a air circulating portion 102 between the motor-housing 21 and the chest portion 20. As can be seen, a refrigerating element 104 of the refrigeration means actively cools the cavity 152 in the chest portion 20. The refrigerating element 104 is connected to a compressor powered by a motor housed in the motor housing 21 and operate in the conventional manner as the refrigeration means.

Air cooled by the refrigerated element 104 is drawn (as indicated by arrows 144) through the spinning fan 140 into the cavity 25 of the body 12 (as indicated by arrow 142), thereby convectively cooling the cavity 25 of body 12. Air is able to return by a portal (not shown).

The fan 140 may be positioned in the opening 150 between the cavity 27 of the chest portion 20 and the cavity 25 of the body to circulate air therebetween.

A barrier may be provided at the bottom of the body 12 covering the opening 150 to prevent items within the cavity 25 falling through the bottom opening 150. This barrier may take the form of a grill which allows air to pass therethrough.

Alternatively the barrier may be a thermally conductive plate, such as a metal sheet. The barrier may additionally seal the bottom of the body 12 such that the cavity 25 of the body 12 is hermetically sealed from the cavity 27 when the body 12 is coupled to the chest portion 20. This may be useful where it is desirable to separate food stuffs, particularly in instances where the smell of one food stuff can contaminate other food stuffs. If this arrangement is used, then either the barrier must be thermally conductive or forced air cooling of the inner casing 11 (such as that depicted in FIG. 10) must be provided in order to cool the cavity 25 and the contents thereof.

The main advantage of the present invention is that it affords a convenient means for increasing the volume capacity of the portable chest refrigerator at times when storage requirements of the user exceed the volume capacity of the portable chest refrigerator.

The various embodiments have different space spacing advantages in terms of height and floor space. Which is useful because space can be very precious in the back of a camper or four-wheel-drive. Another advantage of some embodiments of the present invention is that the temperature in different zones can be differentiated or made the same.

The skilled addressee will realise that modification and variations may be made to the present invention without departing from the basic inventive concept. Such modifications and variations may include using a further alternative to the lid or the door described in the above mentioned embodiments. For example, a pivotal door may be hingedly connected to a longitudinal side wall of the body. The present invention may also applicable to non-portable chest refrigerators or freezers.

Such modifications and variations as would be apparent to the skilled address are intended to fall within the scope of the present invention, the nature of which is to be determined from the foregoing description and appended claims.

What is claimed is:

1. A compartment for augmenting available space in a chest refrigerator, said compartment comprising:

a body configured to be hingedly coupled, in use, to a chest portion of the chest refrigerator in a hermetically sealed manner such that the body may be pivoted to allow access to an inside of the chest portion, the body having a cavity therein for receiving items to be refrigerated in use, the body being arranged such that when coupled to the chest portion the cavity is refrigerated by the chest portion, the body also having an opening for providing access to items in the cavity in use, wherein the body is arranged to be coupled to a door for covering the opening in a hermetically sealed manner.

2. A compartment according to claim 1, wherein the body is arranged to be hingedly coupled to the door.

3. A compartment according to claim 1, wherein the opening is in the top of the body.

4. A compartment according to claim 1, wherein the opening is in a side wall of the body.

5. A compartment according claim 1, wherein the body is releasably coupled to the chest portion, such that the body may be detached from the chest portion.

6. A compartment according to claim 1, wherein the body includes a bottom opening to allow thermal communication between the cavity and the inside of the chest portion in use.

7. A compartment according to claim 6, wherein a barrier is provided across the bottom opening to prevent items in the cavity falling through the bottom opening.

8. A compartment according to claim 7, wherein the barrier is in the form of a grill.

9. A compartment according to claim 7, wherein the barrier is removable from the body.

10. A compartment according to claim 1, wherein an interface between the body and the chest portion is hermetically sealed by a sealing means depending downwardly from a lower periphery of the bottom of the body.

11. A compartment according to claim 1, wherein a periphery of the body surrounding the opening is arranged to provide a hermetic seal between the body and a sealing means depending towards the body from a periphery of an inner face of the door when the sealing means is in contact with the periphery of the body in use.

12. A compartment according to claim 1, wherein the door forms part of a drawer in a side wall of the cavity.

13. A compartment according to claim 1, wherein the body is configured to be positioned between the door and the chest portion in use.

14. A compartment according to claim 1, wherein the body is thermally insulated, such that atmospheric heat is shielded from the cavity.

15. A compartment according to claim 1, wherein the body includes an air circulator for circulating air in the cavity and in the chest portion in use.

16. A compartment for augmenting available space in a chest refrigerator, said compartment comprising:

a body configured to be hingedly coupled, in use, to a chest portion of a chest refrigerator in a hermetically sealed manner such that the body may be pivoted to allow access to an inside of the chest portion, the body having a cavity therein for receiving items to be refrigerated in use, the cavity arranged to be refrigerated by the chest portion in use; and, a door for providing access to the cavity, when opened, and arranged to be hermetically sealed when closed.

17. A compartment according to claim 16, wherein the door is from the chest refrigerator.

18. A compartment according to claim 16, wherein the door is hingedly coupled to the body.

19. A compartment according to claim 16, wherein the door is removably hinged to the body.

20. A compartment according to claim 16, wherein the body is releasably coupled to the chest portion, such that the body may be detached from the chest portion.

21. A compartment according to claim 16, wherein the body includes a bottom opening to allow thermal communication between the cavity and the inside of the chest portion in use.

22. A compartment according to claim 21, wherein a barrier is provided across the bottom opening to prevent items in the cavity falling through the bottom opening.

23. A compartment according to claim 22, wherein the barrier is in the form of a grill.

24. A compartment according to claim 22, wherein the barrier is removable from the body.

25. A compartment according to claim 16, wherein an interface between the body and the chest portion is hermetically sealed by a sealing means depending downwardly from a lower periphery of the bottom of the body.

26. A compartment according to claim 16, wherein an interface between the body and the door is hermetically sealed by a sealing means depending towards the body from a periphery of an inner face of the door.

27. A compartment according to claim 16, wherein the door is in the top of the body.

28. A compartment according to claim 16, wherein the door is in a side wall of the body.

29. A compartment according to claim 16, wherein the door forms part of a drawer in a side wall of the cavity.

30. A compartment according to claim 16, wherein the body is configured to be positioned between the door and the chest portion in use.

31. A compartment according to claim 16, wherein the body is thermally insulated, such that atmospheric heat is shielded from the cavity.

32. A compartment according to claim 16, wherein the body includes an air circulator for circulating air in the cavity and in the chest portion in use.

33. A chest refrigerator comprising:

a chest portion having a first cavity therein for receiving items to be refrigerated;

a refrigeration unit for refrigerating the chest portion;

an augmentative body hingedly coupled to the chest portion in a hermetically sealed manner such that the body may be pivoted to allow access to the first cavity, the body having a second cavity therein for receiving items to be refrigerated in use, the second cavity being refrigerated by refrigeration of the chest portion; and, a door for providing access to the cavity, when opened, and arranged to hermetically seal the chest portion and body when closed.

34. A chest refrigerator according to claim 33, wherein the body is releasably coupled to the chest portion, such that the body may be detached from the first chest portion.

35. A chest refrigerator according to claim 33, wherein an opening in the bottom of the body allows thermal communication between the first and second cavities.

36. A chest refrigerator according to claim 35, wherein a barrier is provided across the opening to prevent items in the second cavity falling into the first cavity.

37. A compartment according to claim 36, wherein the barrier is in the form of a grill.

38. A chest refrigerator according to claims 36, wherein the grill is removable.

39. A chest refrigerator according to claim 33, wherein an interface between the body and the chest portion is hermetically sealed by a sealing means depending downwardly from a lower periphery of the bottom of the body.

40. A chest refrigerator according to claim 33, wherein an interface between the body and the door is hermetically sealed by a sealing means depending towards the body from a periphery of an inner face of the door.

41. A chest refrigerator according claim 33, wherein the body is thermally insulated, such that heat is shielded from the second cavity therein.

42. A chest refrigerator according to claim 33, wherein the door is in the top of the body.

43. A chest refrigerator according to claim 33, wherein the door in is a side wall of the body.

44. A chest refrigerator according to claim 33, wherein the door forms part of a drawer in a side wall of the cavity.

45. A chest refrigerator according to claim 33, wherein the body includes an air circulator for circulating air in the second cavity and first cavity.

46. A chest refrigerator according to claim 33, wherein the chest portion includes an air circulator for circulating air in the second cavity and first cavity.

47. An augmentative refrigerator compartment for use with a portable chest refrigerator, the augmentative refrigerator compartment comprising an open-topped and open-bottomed box member and a sealing means depending continuously around a lower periphery of the box member, wherein the box member is arranged in use to be mounted upon a chest portion of the portable chest refrigerator and between the chest portion and lid portion of the portable chest refrigerator such that the sealing means affords a hermetic seal between the box member and the chest portion for allowing the chest portion to cool the inside of the box member, the arrangement being such that in use a first temperature zone is formed in the chest portion and a second temperature zone is formed in a space defined by the box member, the temperature of the first temperature zone being less than the temperature of the second temperature zone, characterized in that the lid portion is hingedly connected to an upper periphery of the box member, and the lower periphery of the box member is hingedly connected to an upper periphery of the chest portion.

* * * * *

UNITED STATES PATENT AND TRADEMARK OFFICE

CERTIFICATE OF CORRECTION

PATENT NO. : 6,951,118 B2
DATED : October 4, 2005
INVENTOR(S) : Brennan

It is certified that error appears in the above-identified patent and that said Letters Patent is hereby corrected as shown below:

Column 10,
Line 1, replace “claims” with -- claim --.

Signed and Sealed this

Twenty-first Day of March, 2006

JON W. DUDAS
*Director of the United States Patent and Trademark Office*